US006327973B2

(12) United States Patent
Duis et al.

(10) Patent No.: US 6,327,973 B2
(45) **Date of Patent: *Dec. 11, 2001**

(54) PRINTING ON A CARTON WITH A VACUUM SUPPORT

(75) Inventors: Donnie J. Duis; David Dolan, both of Jacksonville, FL (US)

(73) Assignee: Johnson & Johnson Vision Products, Inc., Jacksonville, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/217,879

(22) Filed: Dec. 21, 1998

(51) Int. Cl.[7] ..... B41F 17/24
(52) U.S. Cl. ..... 101/41; 101/35
(58) Field of Search ..... 101/474, 415, 101/407.1, 126, 25, 41, 43, 44, 37, 40

(56) References Cited

U.S. PATENT DOCUMENTS

| | | | | |
|---|---|---|---|---|
| 2,631,528 | * | 3/1953 | Wood | 101/44 |
| 3,020,835 | * | 2/1962 | Hyder, Jr. et al. | 101/44 |
| 3,962,970 | * | 6/1976 | Tielrooy | 101/38 |
| 4,033,254 | * | 7/1977 | Tobey et al. | 101/44 |
| 4,204,469 | | 5/1980 | Johnson . | |
| 4,390,386 | | 6/1983 | Bartl . | |
| 4,489,651 | * | 12/1984 | De luca et al. | 101/93.36 |
| 4,620,738 | * | 11/1986 | Schwartz et al. | 294/64.1 |
| 4,896,595 | * | 1/1990 | Beckett, Jr. | 101/44 |
| 4,913,048 | * | 4/1990 | Tittgemeyer | 101/141 |
| 5,156,088 | * | 10/1992 | Tohdo | 101/35 |
| 5,193,456 | * | 3/1993 | Wolfe et al. | 101/40 |
| 5,207,156 | * | 5/1993 | Helling | 101/38.1 |
| 5,323,701 | * | 6/1994 | Sommer | 101/126 |
| 5,383,400 | * | 1/1995 | Szyszko | 101/126 |
| 5,415,340 | * | 5/1995 | Calvert et al. | 229/3.1 |
| 5,776,280 | * | 7/1998 | Puckett et al. | 156/235 |
| 5,960,933 | * | 10/1999 | Albrecht | 198/689.1 |

FOREIGN PATENT DOCUMENTS

| | | | |
|---|---|---|---|
| 0401959 A1 | | 12/1990 | (EP) . |
| 10921 | | 5/1914 | (GB) . |
| 56-15358 | * | 2/1981 | (JP) . |
| 56-42681 | * | 4/1981 | (JP) . |
| 62-174181 | * | 7/1987 | (JP) . |

* cited by examiner

*Primary Examiner*—Daniel J. Colilla
(74) *Attorney, Agent, or Firm*—Anne B. Kiernan

(57) ABSTRACT

This invention provides a support for a carton which supports said carton during printing comprising a flat portion which is inserted into said carton. This invention further provides a method of printing on a carton comprising the steps of supporting said carton with a support comprising a flat portion; and printing on said carton.

20 Claims, 4 Drawing Sheets

PRINTING ON A CARTON WITH A VACUUM SUPPORT

FIELD OF THE INVENTION

This invention relates to a support to hold a carton while printing on the carton. More particularly, this invention relates to a support that is inserted into a carton to hold the carton while printing on the carton.

BACKGROUND OF THE INVENTION

Carton blanks for contact lens containers are shipped from the carton supplier with most of the necessary information printed on them, with blank areas on the cartons for receipt of variable information, such as, the lot number, barcodes, design (e.g., power), and expiration date of the product. Carton blanks are often supplied having pre-glued areas, e.g. the lid or side flaps. The pre-glued areas of the carton have two layers of paper, and therefore, these areas of the carton are not flat. Further, fold lines in the carton, which form the edges at the intersection of two surfaces cause the surfaces of the carton to be irregular. Attempts to print on the flat blanks can result in illegible printed information.

One solution is not to print on the carton and to add additional information by adding an adhesive label to the carton; however, adhesive labels are expensive. Another alternative is to emboss areas of the carton which do not overlap when the carton is flat; however, that limits the areas which can be printed on, and cannot readily be used to print some kinds of information, e.g. barcodes.

There is a need for an apparatus to remedy the problem of printing on a partially pre-glued carton so that legible print can be added to the carton.

SUMMARY OF THE INVENTION

This invention provides a support for a partially pre-glued carton, said support comprising:

a flat portion which can be inserted into the partially pre-glued carton and which is used to support at least one surface of said carton during printing.

In the preferred embodiment said flat portion further comprises holes in said flat portion, wherein a vacuum source is attached to said holes in said flat portion.

This invention further provides a method of printing on a partially pre-glued carton comprising the steps of:

inserting a support into a partially pre-glued carton; and printing on said carton.

The support provides a flat portion which holds the surface of the carton flat so that legible print can be added to one or more surfaces of the carton. This invention can be used to add information, particularly variable information to cartons, particularly contact lens cartons by the contact lens manufacturer in a cost-effective way.

DETAILED DESCRIPTION OF THE INVENTION

Figure 1:
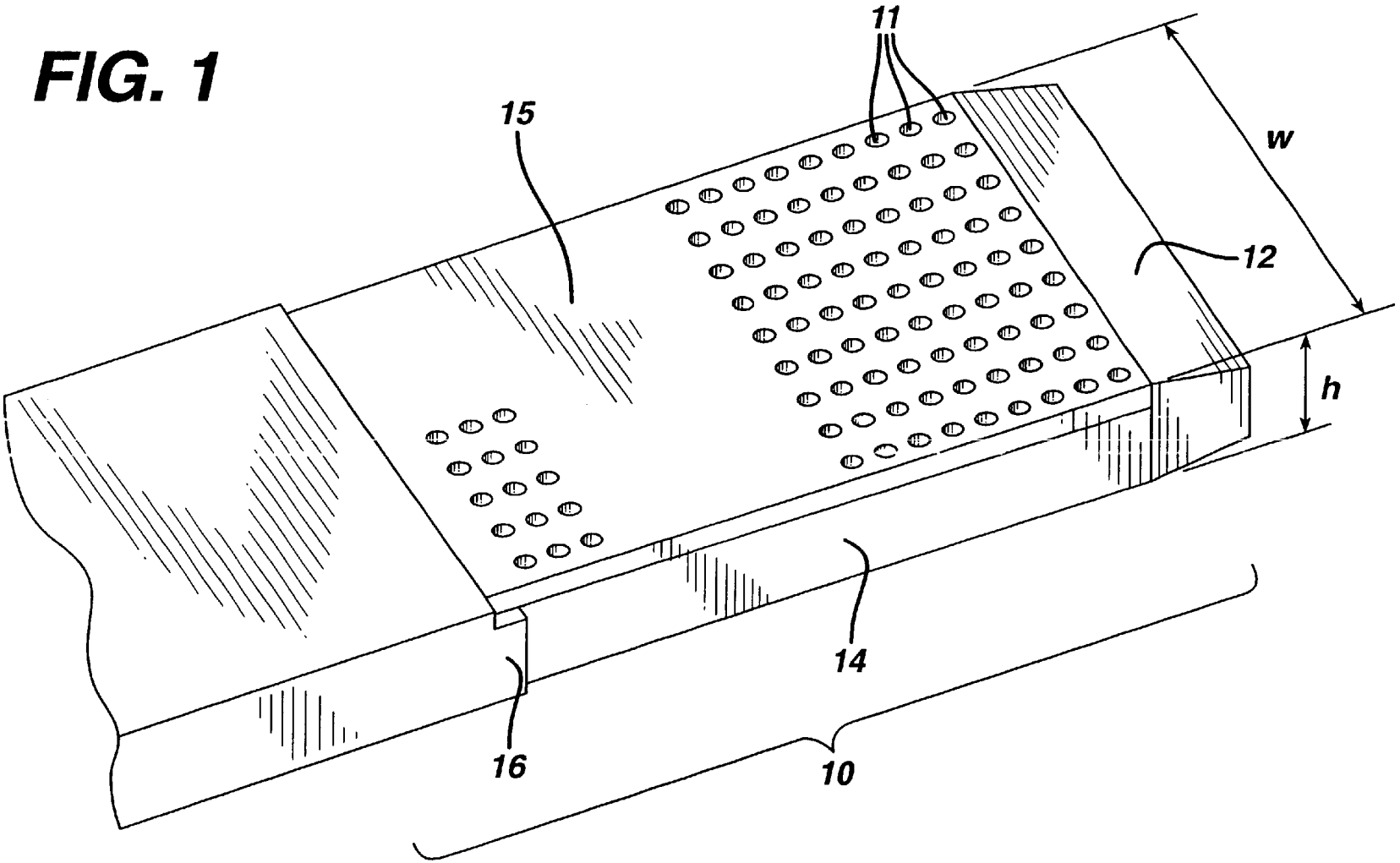
FIG. 1 is a perspective view of the support of this invention.

One of the preferred supports is shown in the drawings. FIG. 1 shows a support 10 of this invention. The support has a flat portion 15 having holes 11 which are connected to a vacuum source (not shown) by vacuum connectors 31 (shown in FIG. 3). The flat portion 15 is the area of the support 10 to which one or more than one surface of the carton is held against by a vacuum during printing. In an alternative embodiment, the support 10 can consist of more than one flat portion which can support and make it possible to print on more than one surface of the carton which are not in-line, i.e., surfaces which are at right angles or parallel to each other. In another preferred embodiment, the support can comprise a flat portion without the holes and vacuum.

The surface of the carton held against the flat portion is the surface of the carton which receives the variable printed information. Preferably, more than one surface of the carton is held against the flat portion and at least one surface, more preferably more than one surface, of the carton receives the variable printed information. The holes 11 are preferably not located in the areas of the carton to receive the variable printed information. The holes 11 are shown as circular in shape; however, any shape can be used, including square, rectangular, etc. Further, the holes are shown as many small openings; however, one or a few larger holes could be used on the support. Ordinary experimentation with the carton and printing area can be used to determine the hole arrangement that works best for a particular printing area and carton.

The flat portion 15 can comprise metal or rubber. In the preferred embodiment, the flat portion 15 comprises rubber adhered to metal. The flat portion 15 is preferably attached to sides 14 which will provide structure to hold the flat portion 15 stiff during printing on the carton. The sides 14 are connected to a bottom 21 (shown in FIGS. 2 and 3). The flat portion 15, the sides 14 and the bottom 21 are all connected to a tapered nose 12 that preferably is tapered on all four sides. The sides 14, bottom 21, and tapered nose 12 can be made out of any material, preferably rubber or metal, more preferably metal. In the preferred embodiment the support 10, except the flat portion, is machined out of a single piece of metal, e.g. aluminum, and the flat portion consists of a metal sheet with rubber bonded to it. Aluminum sheets with bonded rubber is commercially available, e.g. from Edmund Scientific Co. The aluminum sheet with bonded rubber is bolted to the rest of the support by bolts (not shown). If the rubber becomes worn or otherwise damaged, it can be replaced without having to replace the entire support. If the flat portion has holes in it, the holes can be added by machining them into the flat portion.

The tapered nose 12 makes it easier to insert the support 10 into a carton. In the preferred embodiment, the support 10 is sized to be about the same width w (in FIG. 1) as the inside width of the carton to assist in alignment of the carton with a printer. Alternatively, a spring plate (not shown) can be added to the support and used inside the carton to properly align the carton on the support. In the preferred embodiment, the length of the flat portion 15 of the support 10 is about the same length as the carton, but it can be any length as long as the area of the carton to receive print is supported. In the preferred embodiment, the height h (in FIG. 1) of the support 10 is about two-thirds the height of the carton, but any height can be used as long as the support can be inserted into the carton. In fact, the support 10 can take any form as long as the support 10 has a flat portion 15 against which the carton is supported during printing. For example, if the flat portion 15 has sufficient strength, the support 10 may only consist of the flat portion 15, or a flat portion and the tapered nose.

Figure 2:
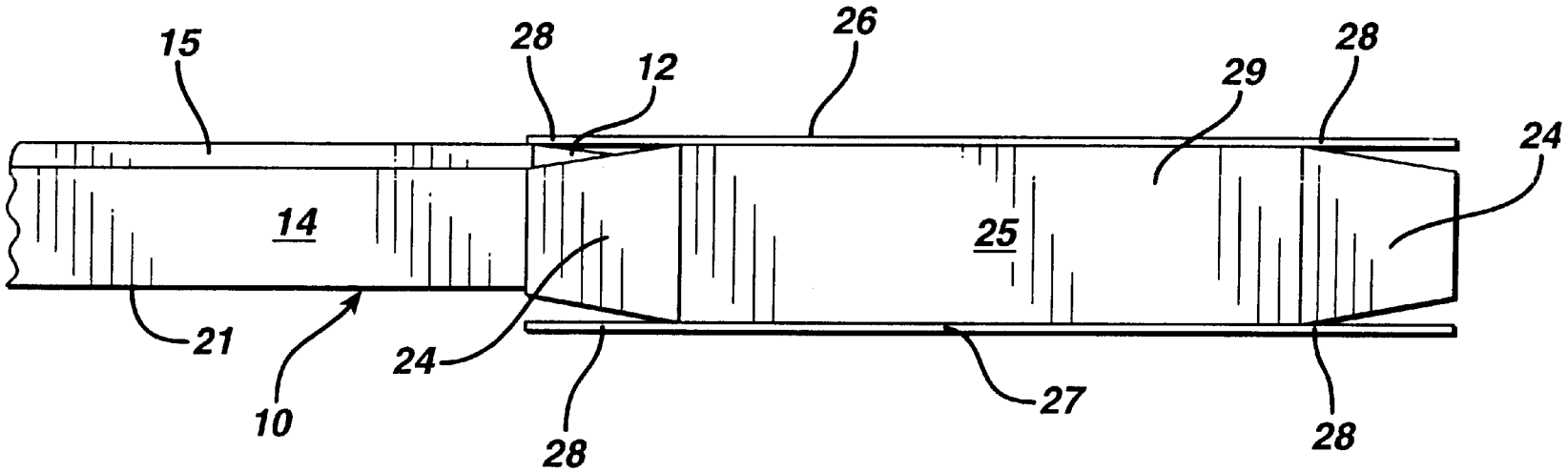
FIG. 2 is a side view of a support partially inserted into a carton.
Figure 3:
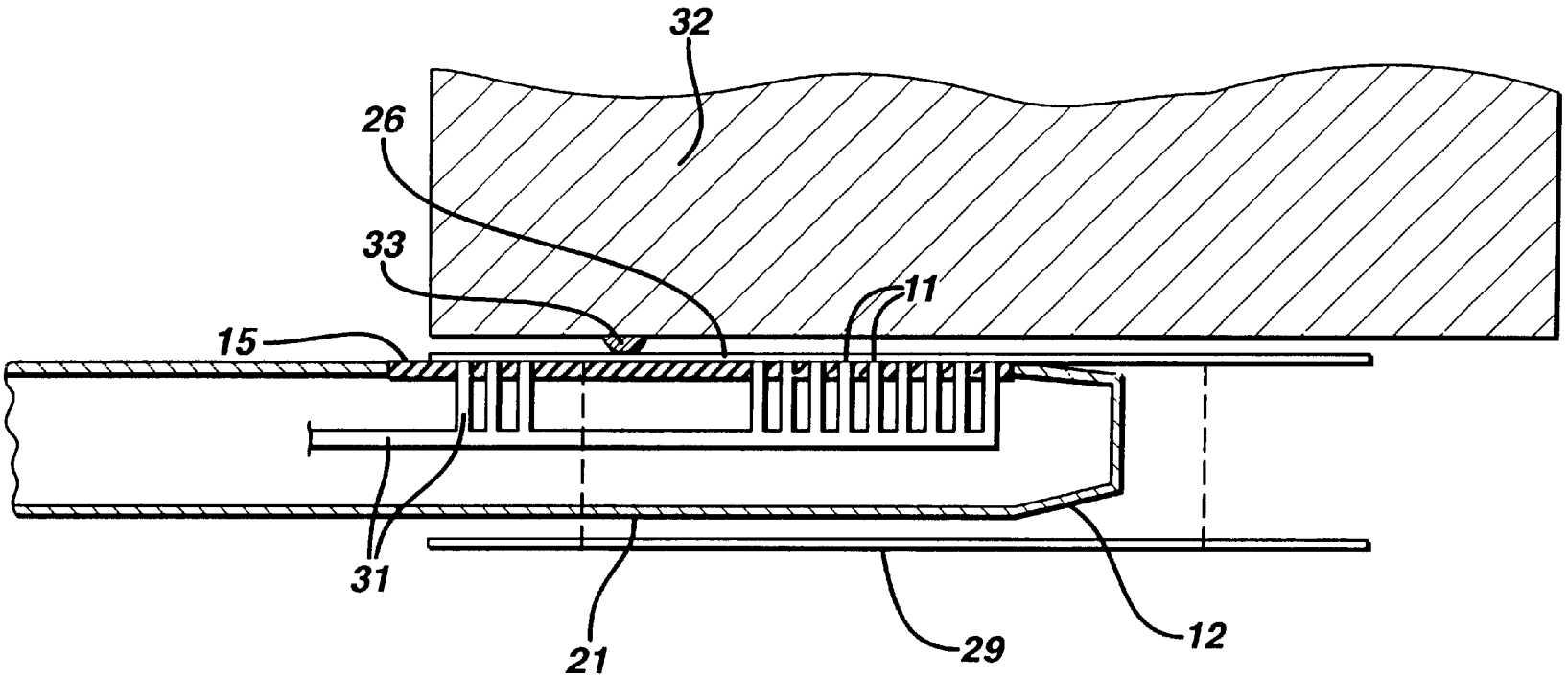
FIG. 3 is a cross-sectional view of a printing system comprising a carton, support and printer showing the support fully inserted into a carton.
Figure 4:
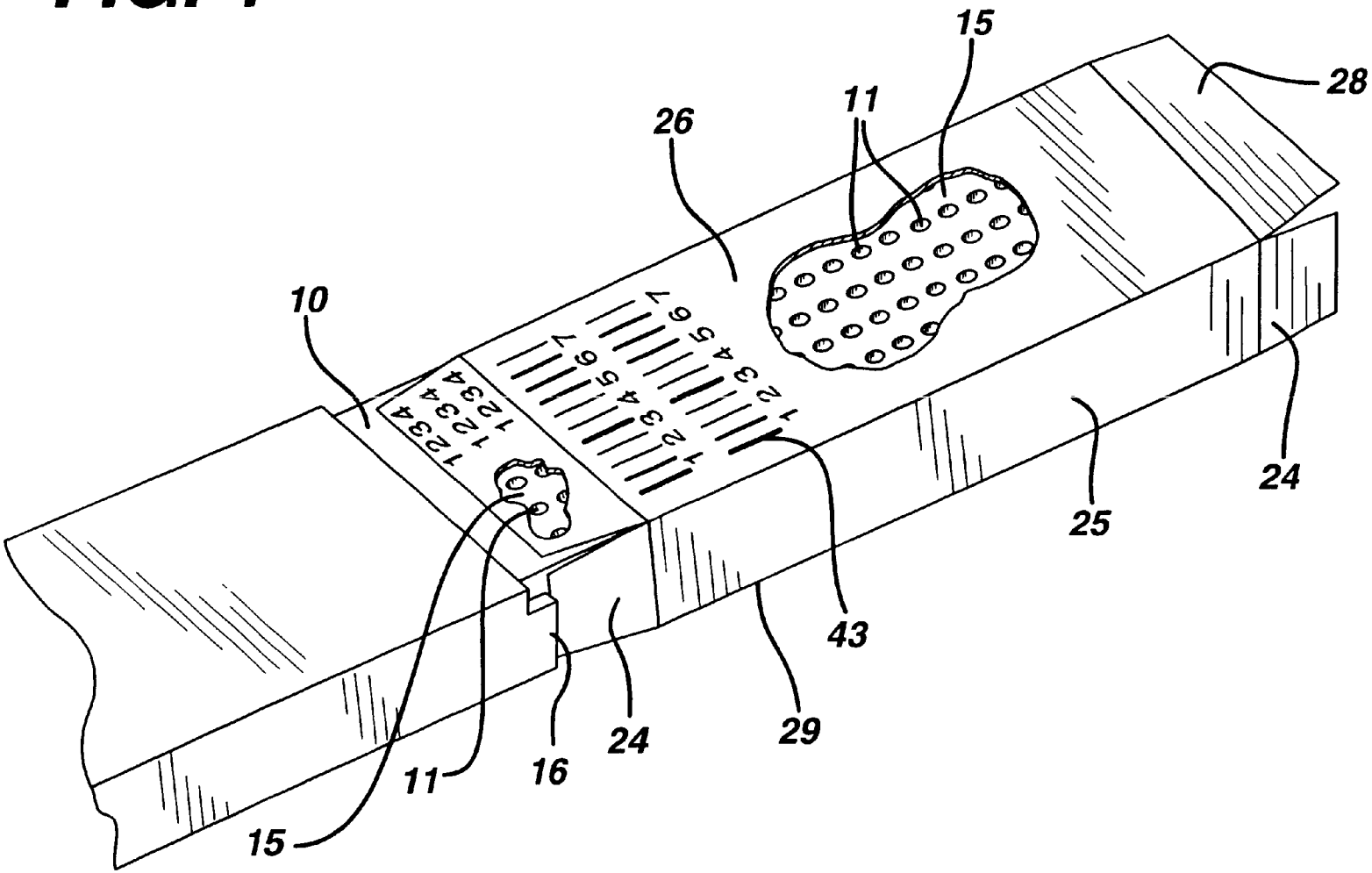
FIG. 4 is a perspective view of the carton filly inserted into a carton having cutaway areas showing the support.

FIGS. 2, 3, and 4 show various views of the support 10 inserted into a carton 29. FIG. 2 shows that the tapered nose 12 of the support 10 is inserted into the carton 29 first. The carton 29 is a partially pre-glued carton, which preferably presents itself to the support 10 partially erected with foldable end flaps 28 in line with the top panel 26 and bottom panel 27 of the carton 29. The foldable side flaps 24 of the carton 29 are in-line with the side panels 25 of the carton 29. In an alternative embodiment, one or both ends (consisting of end flaps and side flaps) of the carton 29 may be pre-glued as long as there is at least one opening in the carton 29 for the support 10 to be inserted into the carton 29.

FIGS. 3 and 4 show the support 10 fully inserted into the carton 29. The support 10 is inserted into the carton 29 until at least one side flap 24 hits at least one alignment guide 16, which is part of the support 10. Alternatively, alignment can be achieved by an alignment guide which can be located to contact other portions of the carton including end flaps or top or bottom panels, or alignment can be achieved using an alignment system, such as a vision system and/or a robot. After the support 10 has been inserted into the carton 29, the vacuum source (not shown), if present, is activated and the portions of the carton to be printed on are held against the support 10 and the carton 29 is moved into position for the printer 32. Alternatively, the printer 32 can be moved to the carton 29. FIG. 3 shows a printer head 33 contacting the surface of the top panel 26 of the carton 29.

FIG. 4 shows the support 10 fully inserted into a carton 29 after information 43 including bar codes and numbers have been printed on the carton 29. One of the end flaps 28 and the top panel 26 of the carton 29 were printed on. The support makes is possible to print on more than one sides, panels, or flaps of the carton, individually referred to as a surface, collectively referred to as surfaces of the carton. The holes 11 and flat portion 15 of the support 10 can be seen in the cutaway areas of the carton.

In the preferred method of using the support, the carton is partially erected by a pick-station which picks up a flat blank, partially erects it and places it onto an index wheel. The index wheel moves the carton toward the support 10. The support 10 inserts itself into the carton, moves itself and the carton up to a printer, turns on a vacuum source, if present, and holds the carton in position while the printer prints on the carton. After the variable information is printed on the carton, the support moves the carton away from the printer, to the index wheel, and places the carton onto the index wheel. The index wheel has a guide on it that catches the carton while the support is removed from the carton.

The printer can be any type of printer for printing on a carton, for example, a laser, embosser, or thermal printer, preferably laser or thermal printer. The support is most suited for contact printing operations, such as thermal printing. The preferred thermal printer is a Thermocode 5775 Thermal Transfer Coder by Open Date using a resin ink, preferably, a ribbon SP330 resin by Open Date. Other printers including the Smart Date 2 thermal printer can be used to print on the cartons.

The preferred embodiments have been described herein; however, alternative embodiments would be known to a person of ordinary skill in the art, which would fall within the scope of the invention defined by the claims.

We claim:

1. A printing system comprising a printer, a removable support and a carton wherein said removable support comprises a flat portion which is inserted into said carton and supports at least one surface of said carton to receive print during printing by said printer, wherein said flat portion comprises holes in said flat portion, and said printing system further comprises a vacuum source, wherein said vacuum source is attached to said holes in said flat portion.

2. The printing system of claim 1 wherein said carton is a partially pre-glued carton.

3. The printing system of claim 1 wherein said removable support further comprises a tapered region.

4. The printing system of claim 1 wherein said holes are located away from the areas of said at least one surface of said carton to receive print from said printer.

5. The printing system of claim 1 wherein said flat portion supports multiple surfaces of said carton.

6. The printing system of claim 1 wherein said flat portion comprises rubber.

7. The printing system of claim 1 wherein said flat portion comprises rubber adhered to metal.

8. The printing system of claim 1 wherein said removable support holds said carton in contact with said printer.

9. The printing system of claim 8 wherein said printer is a thermal printer.

10. The printing system of claim 1 wherein said flat portion supports two surfaces of said carton.

11. The printing system of claim 10 wherein said printer is capable of printing on said two surfaces of said carton.

12. The printing system of claim 11 wherein said two surfaces are at right angles to each other.

13. The printing system of claim 11 wherein said two surfaces are parallel to each other.

14. A method of printing on a carton comprising the steps of:

inserting a flat portion of a removable support into a carton;

adhering said carton to said removable support by a vacuum;

and printing on at least one surface of said carton, while said surface is supported by said flat portion of said removable support.

15. The method of claim 14 wherein said printing step is performed by a thermal printer.

16. The method of claim 14, wherein said flat portion supports at least two surfaces of said carton.

17. The method of claim 14, wherein at least two surfaces of said carton are printed on during said printing step.

18. The method of claim 14 wherein said vacuum holds said carton during said printing step.

19. The method of claim 14 wherein during said adhering step, said at least one surface of said carton to receive print is held against said flat portion of said removable support.

20. The method of claim 14 wherein during said adhering and printing steps, said at least one surface of said carton to receive print is held against said flat portion of said removable support by said vacuum.

* * * * *